US009081366B2

(12) United States Patent
Bonhoff

(10) Patent No.: US 9,081,366 B2
(45) Date of Patent: Jul. 14, 2015

(54) TIMEPIECE TO DISPLAY A VALUE OF A TIME UNIT

(71) Applicant: Hannes Bonhoff, Berlin (DE)

(72) Inventor: Hannes Bonhoff, Berlin (DE)

( * ) Notice: Subject to any disclaimer, the term of this patent is extended or adjusted under 35 U.S.C. 154(b) by 66 days.

(21) Appl. No.: 14/011,795

(22) Filed: Aug. 28, 2013

(65) Prior Publication Data

US 2014/0064045 A1 Mar. 6, 2014

(30) Foreign Application Priority Data

Aug. 28, 2012 (DE) ..... 10 2012 017 414

(51) Int. Cl.
*G04B 19/00* (2006.01)
*G04B 19/06* (2006.01)
*G04B 45/00* (2006.01)

(52) U.S. Cl.
CPC ..... *G04B 19/06* (2013.01); *G04B 19/00* (2013.01); *G04B 45/0061* (2013.01)

(58) Field of Classification Search
CPC ..... G04B 45/00
USPC ..... 368/77, 223, 232, 233; 434/304
See application file for complete search history.

(56) References Cited

U.S. PATENT DOCUMENTS

| | | | | |
|---|---|---|---|---|
| 5,051,968 | A * | 9/1991 | Calabrese | 368/76 |
| 5,359,578 | A * | 10/1994 | Truini | 368/76 |
| 7,496,003 | B2 * | 2/2009 | Muller | 368/228 |
| 7,502,280 | B2 * | 3/2009 | Mueller | 368/77 |
| 7,821,879 | B2 * | 10/2010 | Buttet et al. | 368/223 |
| 7,839,727 | B2 * | 11/2010 | Buttet et al. | 368/223 |
| 8,264,910 | B2 * | 9/2012 | Fuisz et al. | 368/10 |
| 8,406,087 | B2 * | 3/2013 | Schneider | 368/77 |
| 2003/0099159 | A1 * | 5/2003 | Herbstman et al. | 368/77 |
| 2009/0154298 | A1 * | 6/2009 | Taylor et al. | 368/77 |
| 2010/0091616 | A1 * | 4/2010 | Bonhoff | 368/80 |
| 2013/0051195 | A1 | 2/2013 | Bonhoff | |
| 2013/0052627 | A1 * | 2/2013 | Tzeng | 434/304 |

FOREIGN PATENT DOCUMENTS

| | | |
|---|---|---|
| CH | 343919 | 2/1960 |

* cited by examiner

*Primary Examiner* — Amy Cohen Johnson
*Assistant Examiner* — Jason Collins
(74) *Attorney, Agent, or Firm* — Schmeiser, Olsen & Watts, LLP

(57) ABSTRACT

A timepiece for displaying a value of a time unit is provided, comprising a read element (5), wherein a rotation of the read element (5) can be controlled manually, and a form element (4), which rotates according to the time unit, wherein the rotation of the form element (4) is independent of a manually induced rotation of the read element (5), wherein the value of the time unit can only be read when the read element (5) and the form element (4) coincide, in that the angular position of the coincidence indicates the value of the time unit.

20 Claims, 17 Drawing Sheets

TIMEPIECE TO DISPLAY A VALUE OF A TIME UNIT

FIELD OF TECHNOLOGY

Figure 1:
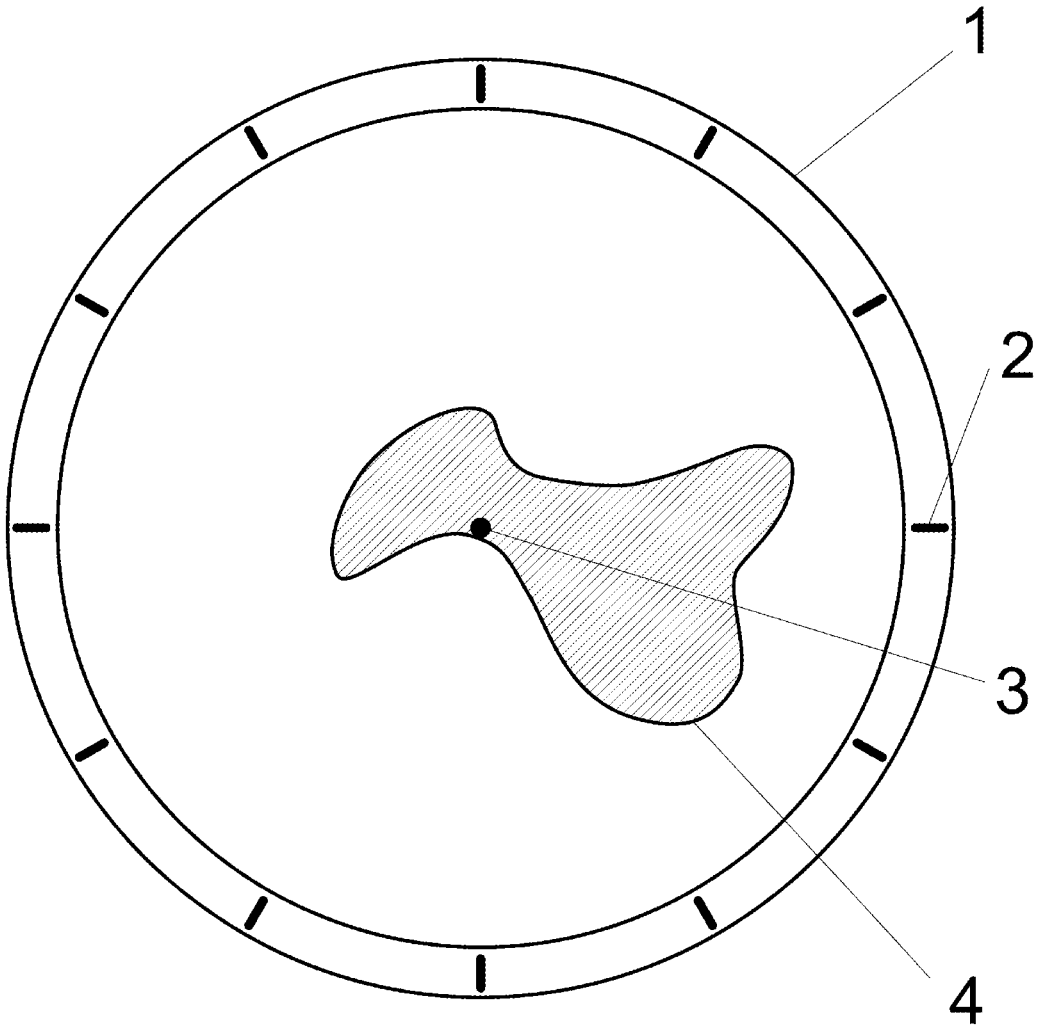

The invention relates to a timepiece to display a value of a time unit.

BACKGROUND

The analog display of the time on a timepiece is usually based on hands for hour, minute and seconds. These hands are driven by a clockwork mechanism or watch movement which is mounted in a case. Through the glass of the case, the angular position of the hands on a scale can be determined, yielding the current time.

In addition to the hands driven by the movement, such as the hour and minute hands, the state of the art also reveals hands that are not driven by the watch movement, see for example, document CH 343 919 A. Such non-movement-driven hands can be adjusted manually without affecting the angular positions and rotary motions of the movement-driven hands and serve for example for measuring the duration of dives on diving watches. In contrast, document DE 10 2010 020 466 A1 discloses a timepiece that features a hand that can be rotated manually, where the manual rotation affects the angular positions of the remaining hands such as the hour and minute hands. For the timepiece described in document DE 10 2010 020 466 A1, a display of the time is affected when the manually rotatable hand coincides with the remaining hands.

For an unambiguous determination of the angular position of the hands for reading the time, the hands must point in a clearly identifiable direction on the time scale. In the design of the various elements of the display of a timepiece, such as hands, scales and numbers, it therefore has to be taken into account that the direction of the hands is clearly visible. If the hands do not display a clearly identifiable direction or are covered by other elements of the display such that the indicated direction is not clear, the current time cannot be read correctly or only with poor precision. The requirement that the hands must display a clearly identifiable direction, therefore, limits the design possibilities of the elements of the display.

SUMMARY

It is an object of the invention to provide a timepiece for displaying a value of a time unit, especially a timepiece with analog time display, which makes it possible to produce timepieces with time displays in greater design flexibility. In particular, a free form design for the hands is to be provided.

A timepiece for displaying a value of a time unit is provided with a read element, wherein a rotation of the read element can be controlled manually, and a form element, which rotates according to the time unit, wherein the rotation of the form element is independent of a manually induced rotation of the read element, wherein the value of the time unit can only be read when the read element and the form element coincide, in that the angular position of the coincidence indicates the value of the time unit.

For reading the value of the time unit, the read element can be rotated manually such that the read element and the form element coincide. The rotation of the read element can stop when coinciding with the form element for reading the value of the time unit. The read element and the form element may rotate about the same axis.

It may be provided that the coincidence of read element and form element is only effected in the rotational position in which the form element and/or the read element indicate the value of the time unit. The timepiece can have a timescale in accordance with the time unit, wherein the form element and/or the read element only indicate the value of the time unit on the timescale when the read element coincides with the form element.

The coincidence of the read element with the form element for reading the time can be effected by partial or complete overlapping of the two elements, by partial or complete framing of one element by the other element, by a coincidence of at least one side or at least one endpoint of one element with at least one side or at least one endpoint of the other element or by a combination of the three variants mentioned above. The way the coincidence of the two elements is effected can be equal for all values of the time unit to be displayed by the timepiece.

The indication of a value of a further time unit can be provided, where a further form element rotates in accordance with the further time unit and the value of the further time unit is displayed similar to the interaction of the read element and the form element, only when the further form element coincides with the read element or a further read element, such that the read element or the further read element and/or the further form element indicate the value of the further time unit.

At least one element of the display can have a disk-shaped figure of any shape. At least one element of the display can have at least one line-shaped or surface-like marking or recess of any shape on a disk-shaped figure of any shape. The disk-shaped figure can rotate eccentrically. At least a part of the shape, marking or recess of a read element can correspond to at least a part of the shape, marking or recess of a form element. The form element can be covered at least partially by another element of the display. The read element can have a shape, recess or marking towards the edge, which increases the reading accuracy.

The read element can rotate according to a seconds hand, where a manually controlled rotation of the read element temporarily interrupts the rotation of the read element according to a seconds hand for the duration of the manually controlled rotation of the read element.

The elements of the display can consist of one or different solid materials. The form element can be rotated by a movement or clockwork with a quartz crystal or a balance wheel as time base.

The elements of the display can be displayed on a monitor or projected onto a screen. The time unit of the value to be displayed by the coincidence of a read element and a form element can be the hour, minute or seconds.

Starting from the angular position in which the read element and the form element coincide to display the value of the unit time, the rotational motion of the form element due to the passage of time causes the form element to depart from the angular position in which the read element and the form element coincide to display the value of the time unit, whereby the form element is in a new angular position in which the form element no longer coincides with the read element. Only after a complete revolution of the form element or a manually generated rotation of the read element, the form element can again coincide with the read element.

In one embodiment, an interactive timepiece is provided with an analog time display, a form element which is rotatably mounted about an axis of rotation of said analogue display, a clockwork or movement, which is suitable to power a rotational motion of the form element around the axis of rotation in accordance with the time unit and a read element which is mounted in a way allowing a manual, free rotation about the axis of rotation or a different axis of rotation, such that a manual rotation of the read element can be executed independently and decoupled from the movement-forced rotation of the form element. Furthermore, markings are provided which are formed with partial markings on the form element and the read element and which at least in a read position of the read element and the form element relative to each other are partially visible in viewing direction towards the analog display. The read position can be set manually by manual rotation of the read element, such that the partial markings on the read element are put in a position assigned to the partial markings on the form element. In the read position, the read element indicates a true or current analog value for the time unit on the analog display, but not in other rotational positions of the read element and the form element relative to each other different from the read position.

In the read position, the form element and the manually rotated read element are arranged in a position relative to each other (relative rotational position) which is determined by the predetermined mutual allocation of the partial markings on the form element and the read element. The partial markings are designed so that the read position is taken in exactly one relative rotational position or relative angular position of the form element and the read element. In other positions of the form element and the read element relative to each other, no true or current value can be read for the time.

It may be provided that the markings have picture elements executed as partial markings on the read element and the form element. It can be provided, for example, that any symbols such as dashes, circles, spots, triangles, or the like, are to be stacked or arranged in a predetermined manner relative to each other in the read position. The predetermined relative position is set by manually rotating the read element.

The markings may represent form elements based on partial markings on the read element and the form element. Form elements are characterized by form or contour sections, where it may be provided that in the read position they are arranged in a form-fit arrangement either partially or fully.

On the form element or the read element, the markings may be arranged in an area of a portion of transparent material, through which the partial markings on the other element, i.e. the read element or the form element, are at least visible in the read position.

It may be provided that the markings on the read element and/or the form element comprise a recess, which, in the viewing direction towards the analog display in the read position at least partially overlaps with positive fit with a corresponding partial marking on the other element, namely the form element or the read element.

In the viewing direction towards the analog display, the read element and the form element may be arranged in a way partially or completely superimposing one another. The form element may be implemented as a hand or pointer.

A further form element with an associated further read element can be provided, for which, comparable with the interrelation of form element and read element, a further read position can be set manually, in which a true analog value is displayed for a further time unit different from the time unit. The further form element and the associated further read element have—comparable to the formation of form element and read element—markings with corresponding partial markings equal to or different from the partial markings of the form element and the read element. The time unit for example represents the hour and the further time unit represents the minutes. The inclusion of a seconds display can also be provided in a similar manner.

According to another embodiment, a clock is provided, in which the angular positions of the clock hands is determined by manually rotating at least one additional form element by successively matching the form element with the hands. Here, the additional form element has a shape that points in a defined direction.

In one embodiment, a timepiece is provided with a first hand (form element), which is driven by a clockwork or movement, and a second hand (read element), which can be rotated manually, wherein the rotational motion of the first hand is independent of a manually generated rotation of the second hand, wherein a time indication with regard to a time unit is effected only when the two hands coincide, in that the second hand points to the angular position of the current time of the time unit viewed, while outside the points in time and angles of the coincidence of the hands a meaningful reading of the time is not possible.

The first hand (form element) may have a shape which does not point in a uniquely identifiable direction. The second hand (read element) may have a shape which points in a uniquely identifiable direction. A part of the second hand can correspond to the shape or a part of the shape of the first hand. Both hands may have the same axis of rotation.

A further hand (further form element) can be provided, which is driven by the clockwork or movement, where the first hand (form element) is rotated in accordance with an hour display and the further hand is rotated in accordance with a minute display. When the second hand (read element) coincides with another hand for reading the time, a partial or complete overlapping of the two hands can occur. When the second hand coincides with another hand for reading the time, a partial or complete framing of one hand by the other hand can occur. When the second hand coincides with another hand for reading the time, a coincidence of the sides of both hands can occur. The second hand may be driven by the clockwork or movement in accordance with the rotational speed of a seconds hand. A manual rotation of the second hand can stop this drive of the clockwork or movement.

In addition to the read element, one embodiment of the clock has an hour hand (form element) and a minute hand (further form element). Here, the current minute is indicated when the read element coincides with the minute hand and the current hour is indicated when the read element coincides with the hour hand.

A coincidence between the read element and the hour (form element) or minute hand (further form element) may be based on a full or partial matching of read element and the respective hand. The sides of the read element and the respective hand for instance can coincide. Likewise, parts of the hand can be covered by the read element or vice versa. A coincidence between read element and hand can also occur when a recess in the read element is filled by a corresponding shape or form by the hand or vice versa. Thus, a coincidence of the read element with the hour or minute hand can generally be facilitated by allowing the read element to partially or completely reproduce the shape of hour and minute hands.

When reading the time, the read element can be rotated in clockwise or counterclockwise direction. Furthermore, the reading of the current time is carried out sequentially, so for example the current minute is read before the current hour is read. In angular positions of the read element and the hands in which none of the hands coincides with the read element, a clear or exact reading of the time is not possible.

In one possible embodiment, the proposed timepiece can be described as follows. The analogue display has time unit markers that are arranged circumferentially. A form element is positioned in one area of the display, which carries out a forced rotation in accordance with the time unit around a axis of rotation. From the combined view of the form element and the time unit markers the current/actual time cannot be read or can only be read with poor precision. Furthermore, a read element is positioned on the display which is mounted in a way allowing a manual rotation about the axis of rotation or a different axis of rotation, wherein said manual rotation is independent and decoupled from the forced rotation of the form element. In a read position, the exact time can be read from the combined view of the read element and the time unit markers. The time read in the read position represents the current/actual time. In the read position, partial markers on the read element and on the form element are positioned in a read position assigned to one another. Only this setting in relation of the partial markings on the form element and the read element allow for an accurate reading of the current/actual time. The combined view of the read element and the time unit markers allows the reading of the actual/current time, which is not possible or only with poor precision from the combination of the form element and the time unit markers. The combined view of the form element and the time unit markers gives the user either no reference for the actual/current time or a reference that leads to a poor interpretation of the actual/current time. A poor precision or inaccurate reading of the time is present, for example, for the time unit minute with 60 time unit markings, when the current/actual minute is read with an error of at least plus/minus one minute.

BRIEF DESCRIPTION

Figure 2:
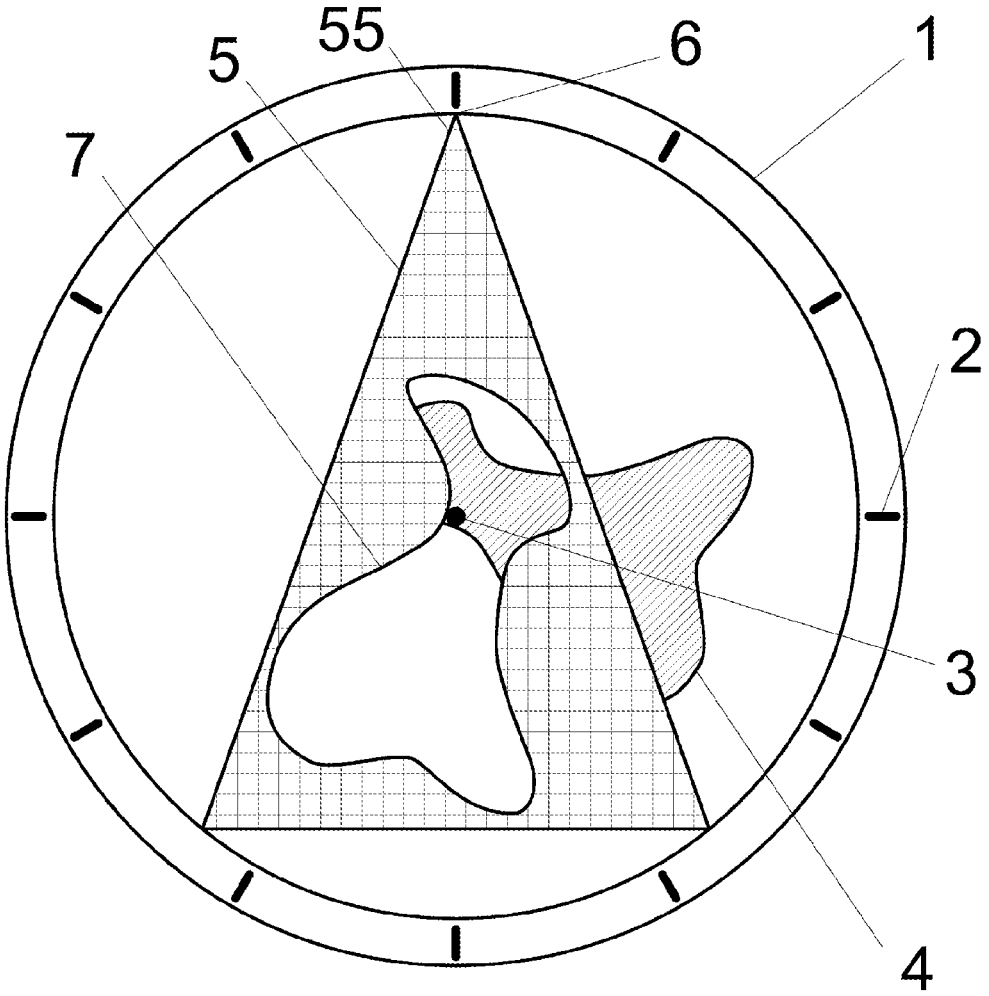
Figure 3:
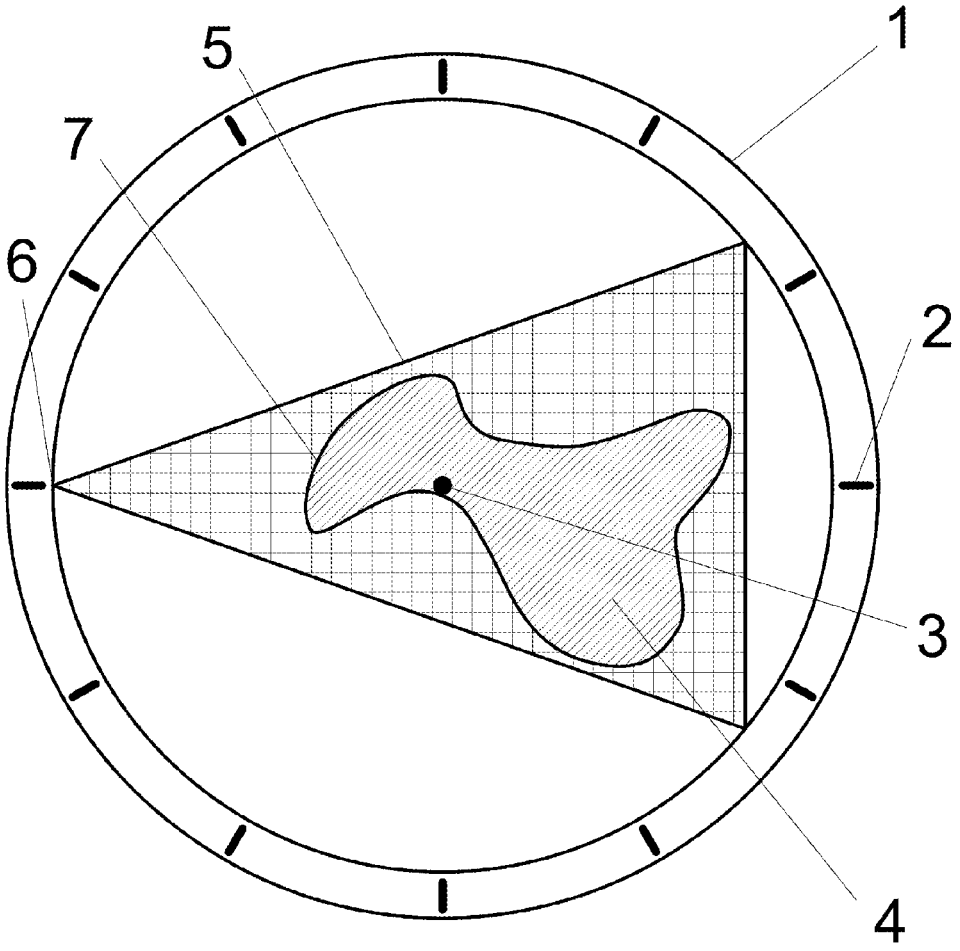
Figure 4:
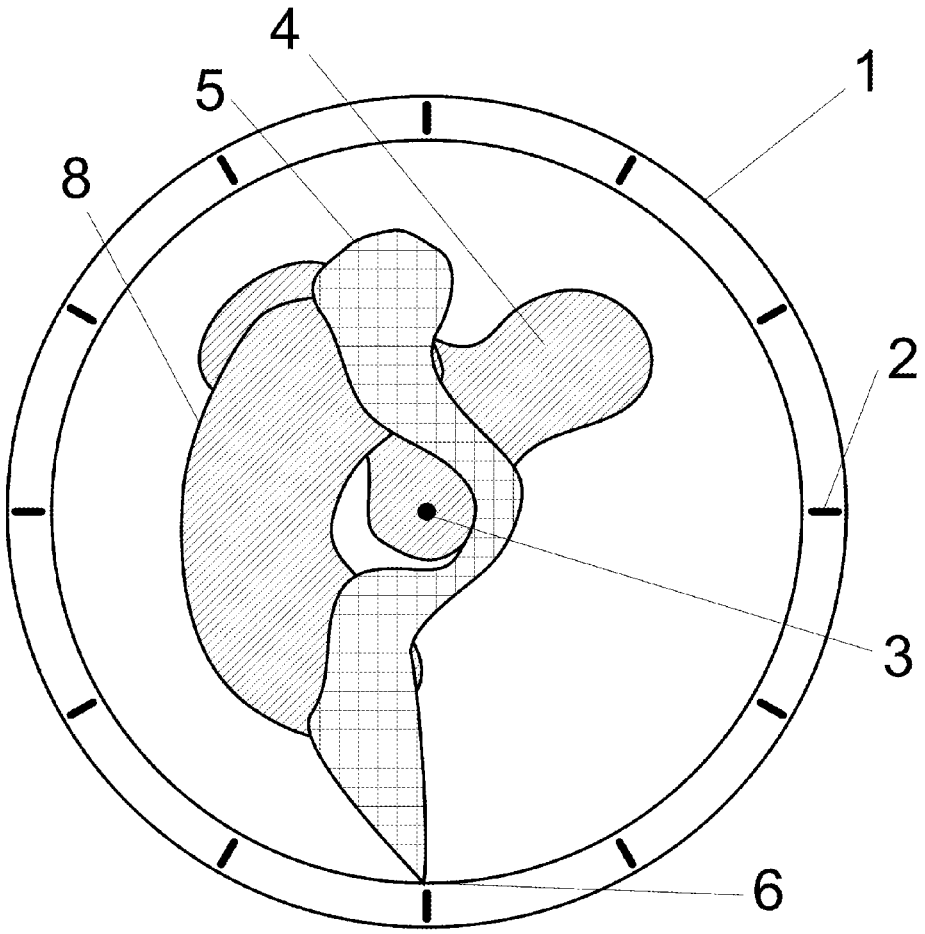
Figure 5:
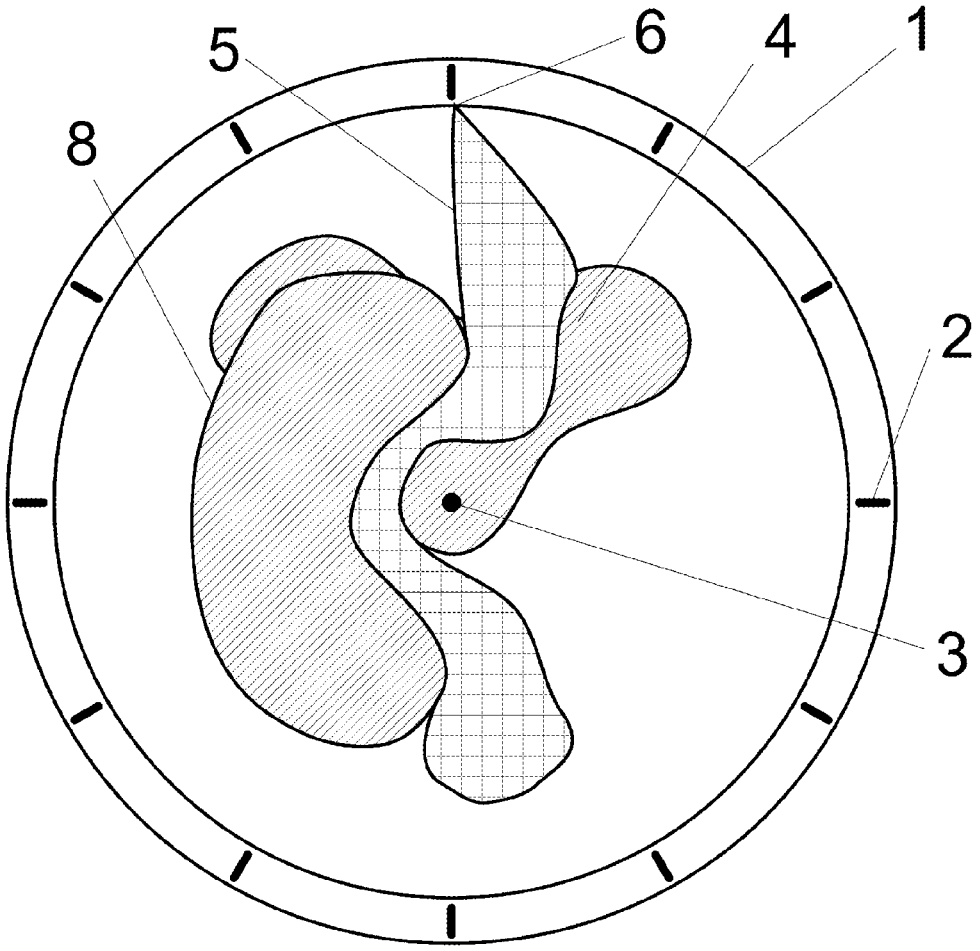
Figure 6:
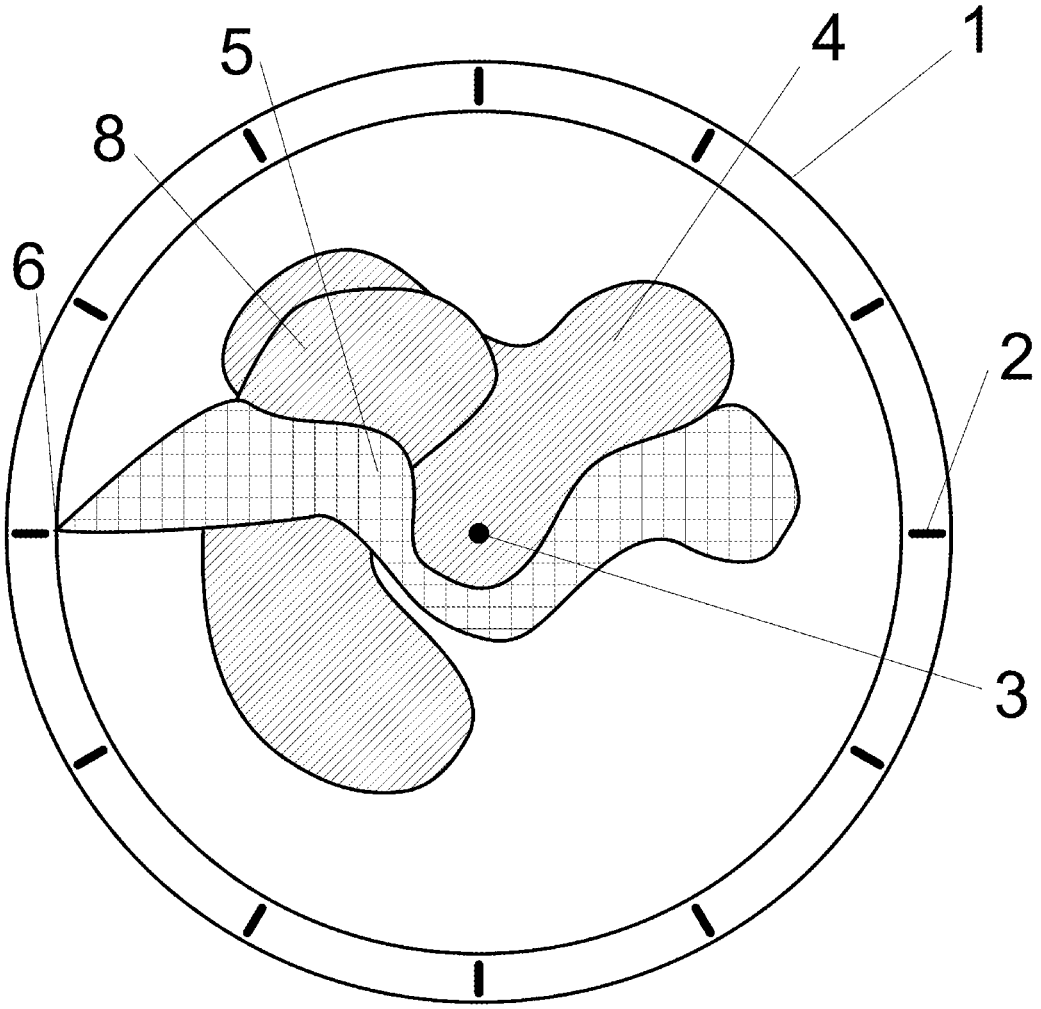
Figure 7:
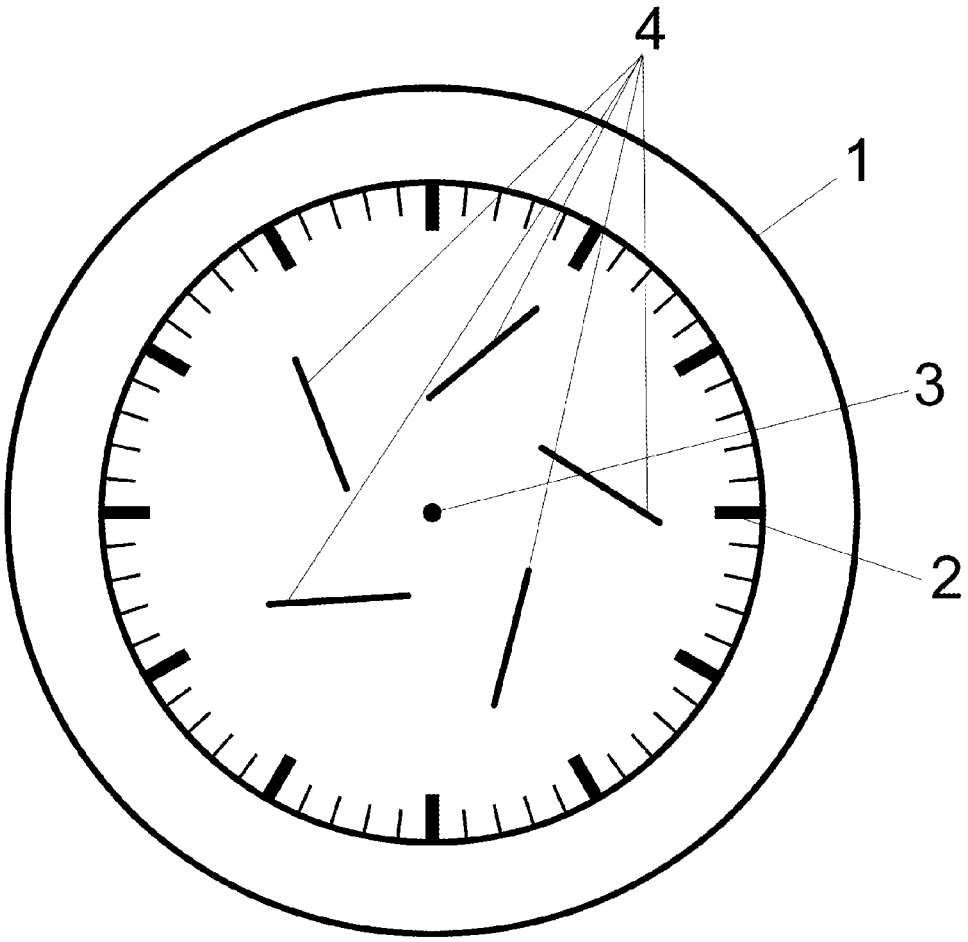
Figure 8:
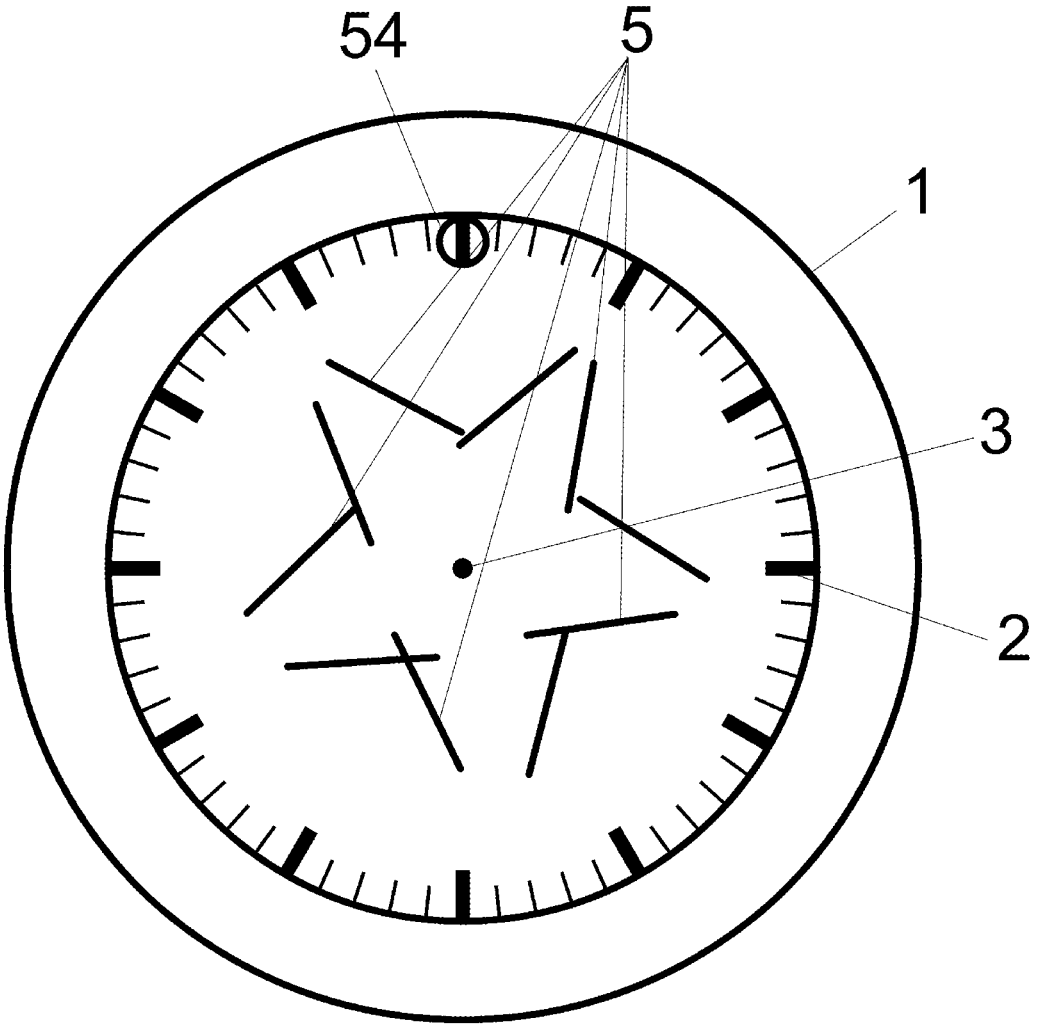
Figure 9:
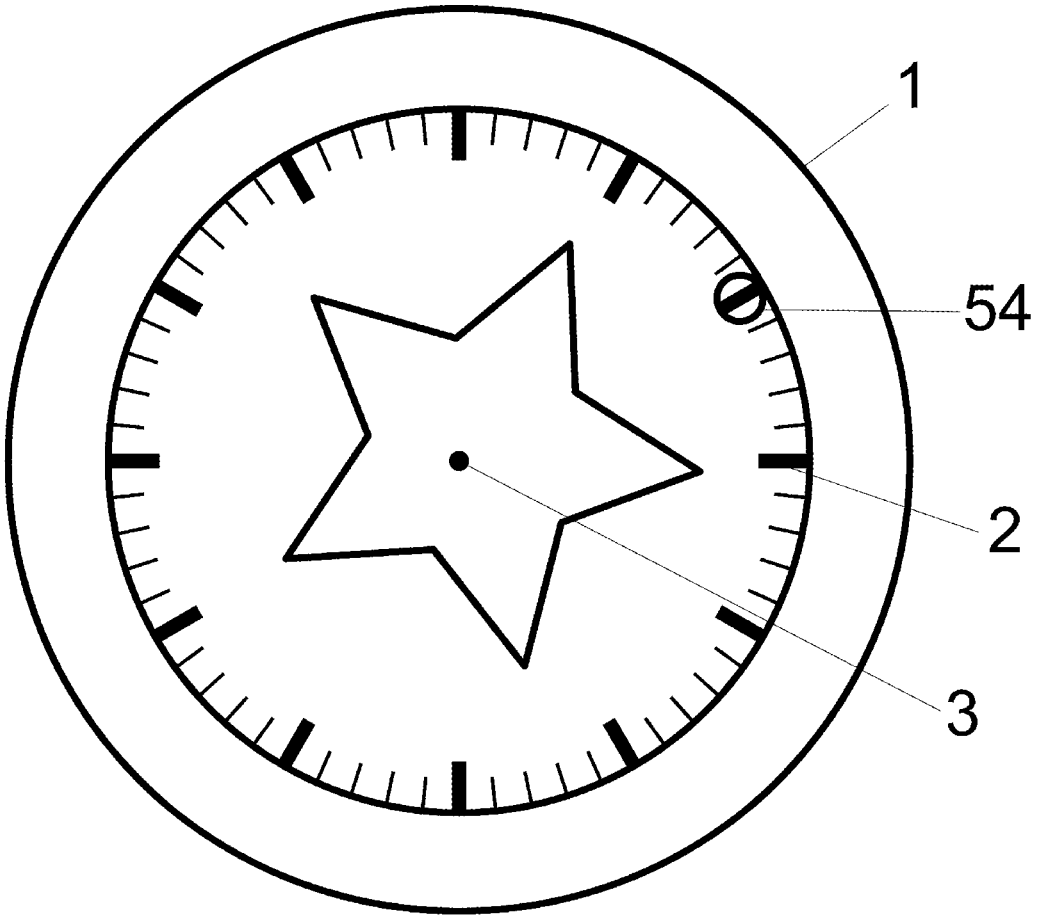
Figure 10:
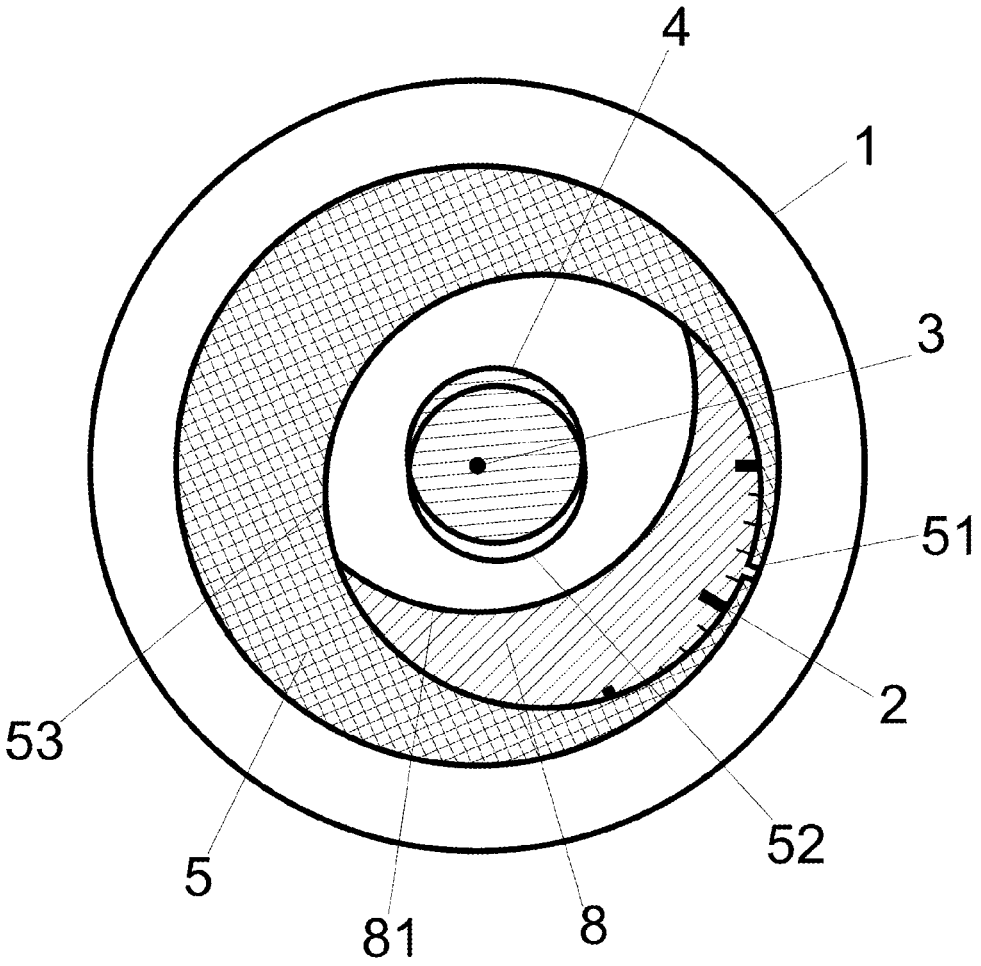
Figure 11:
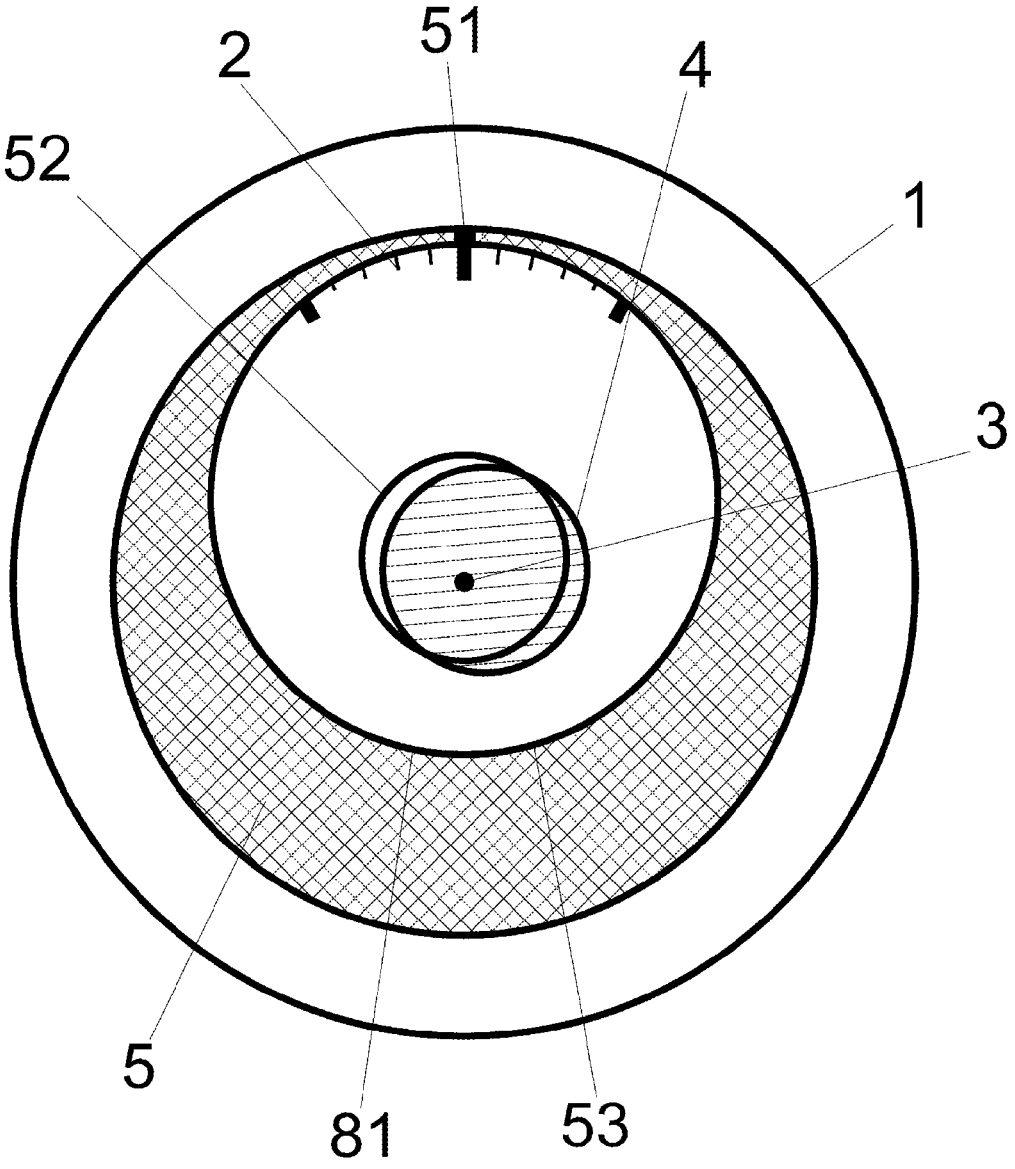
Figure 12:
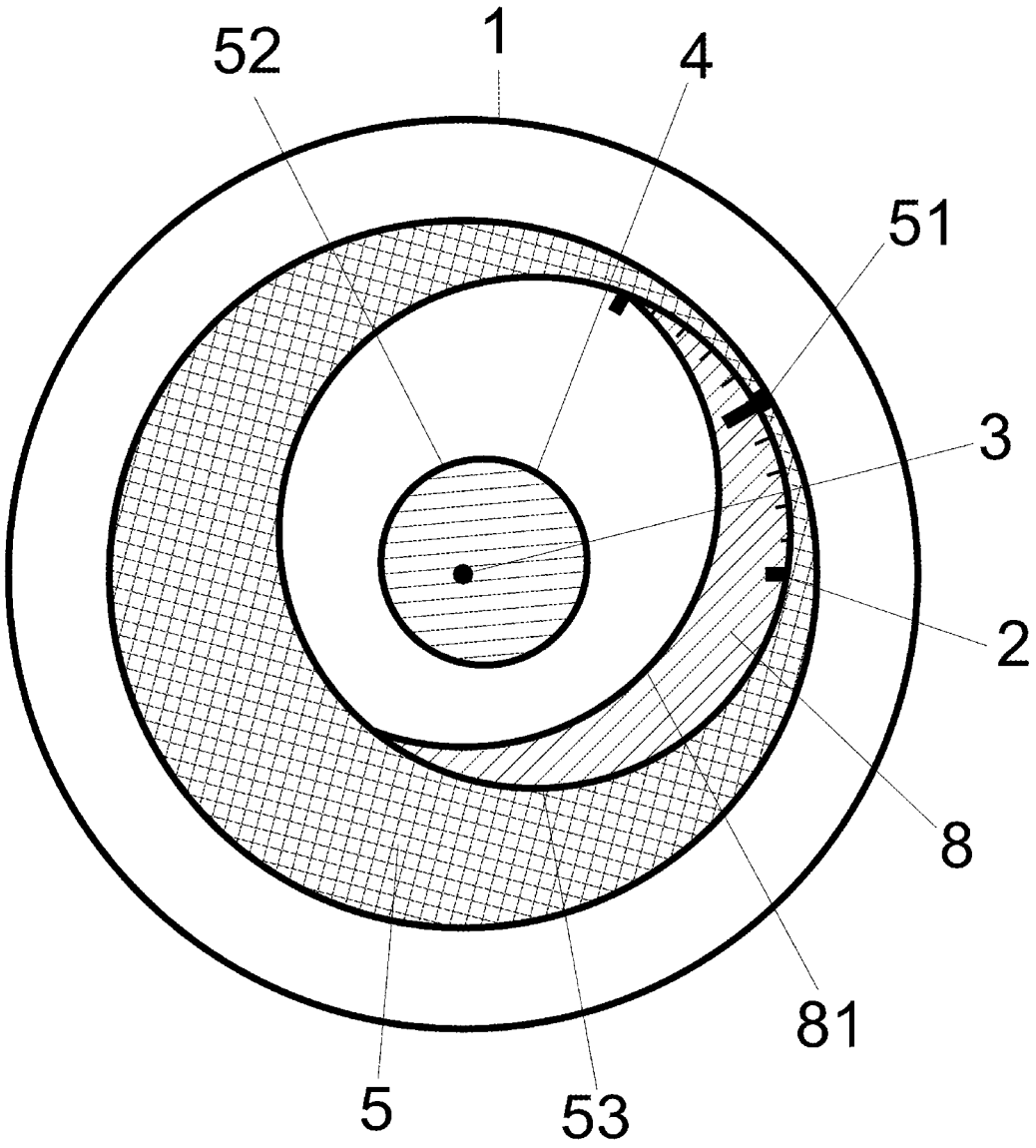
Figure 13:
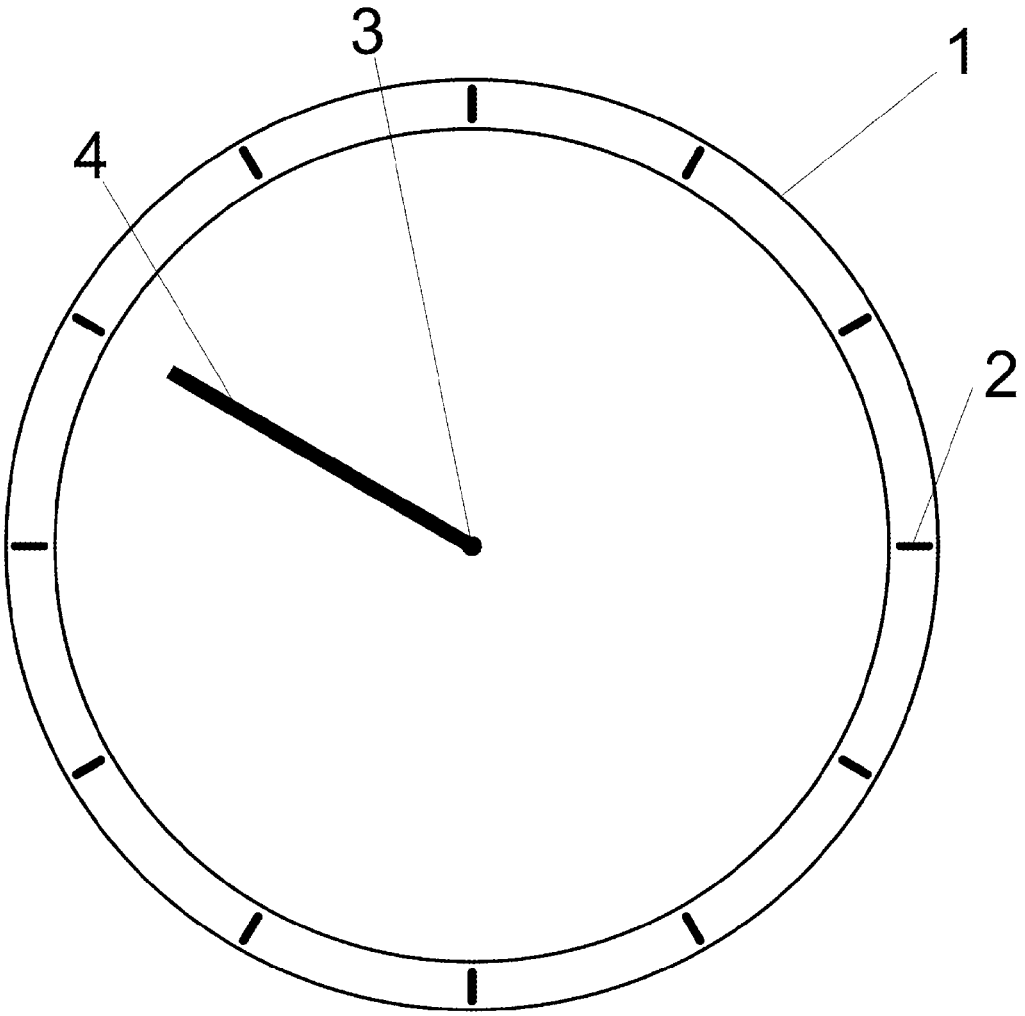
Figure 14:
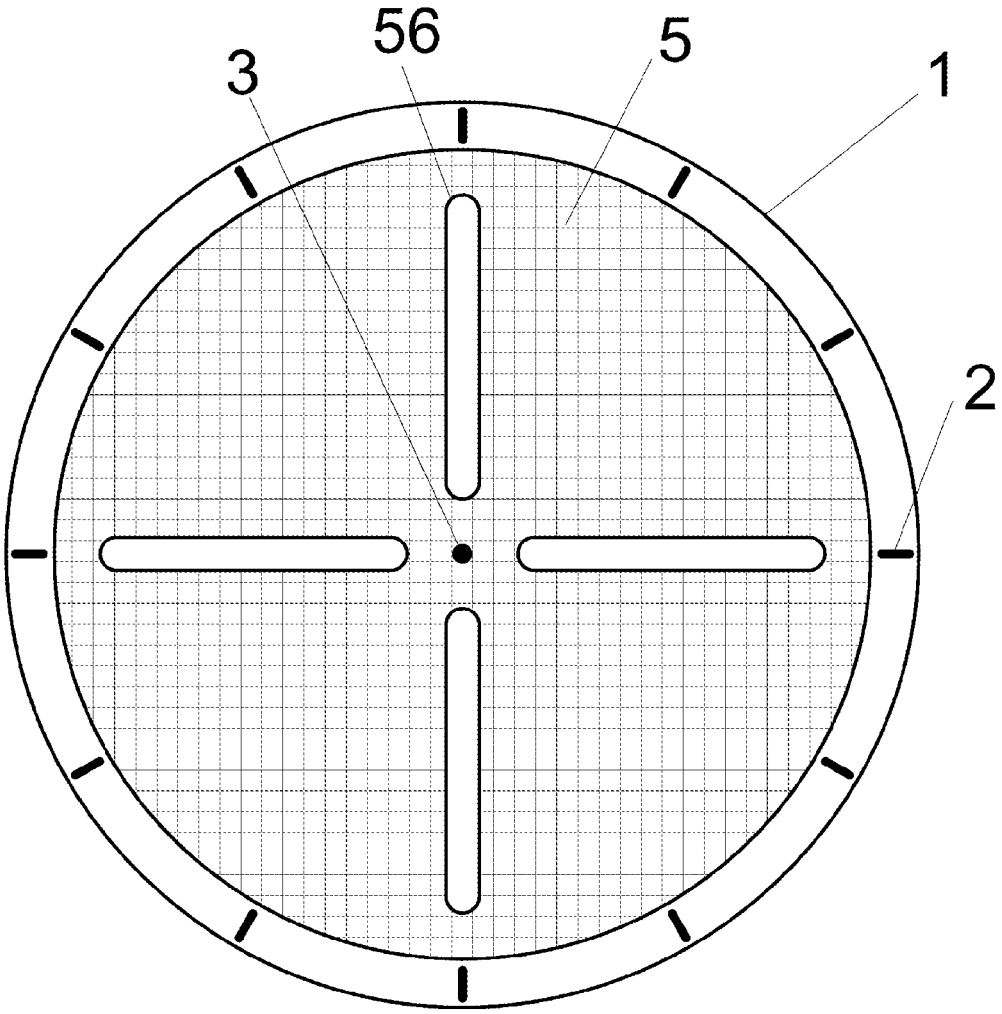
Figure 15:
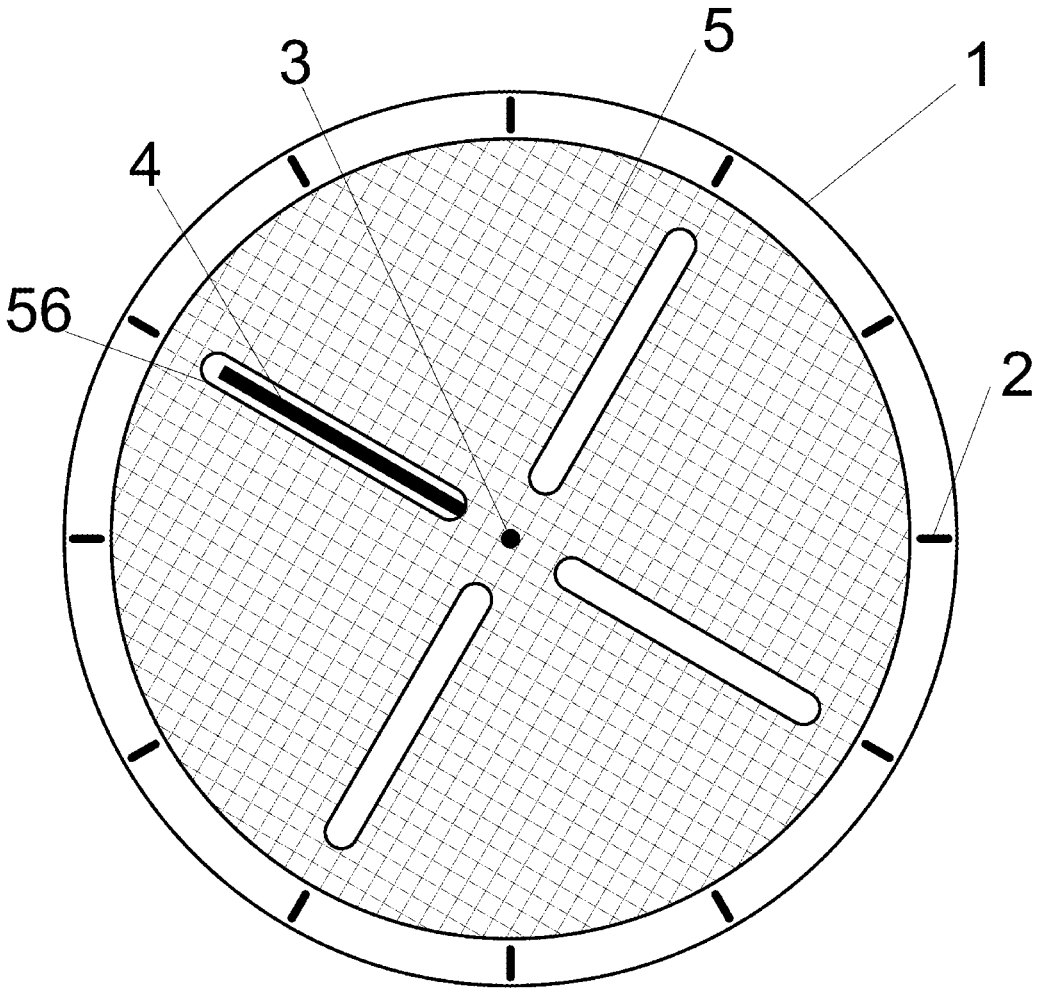
Figure 16:
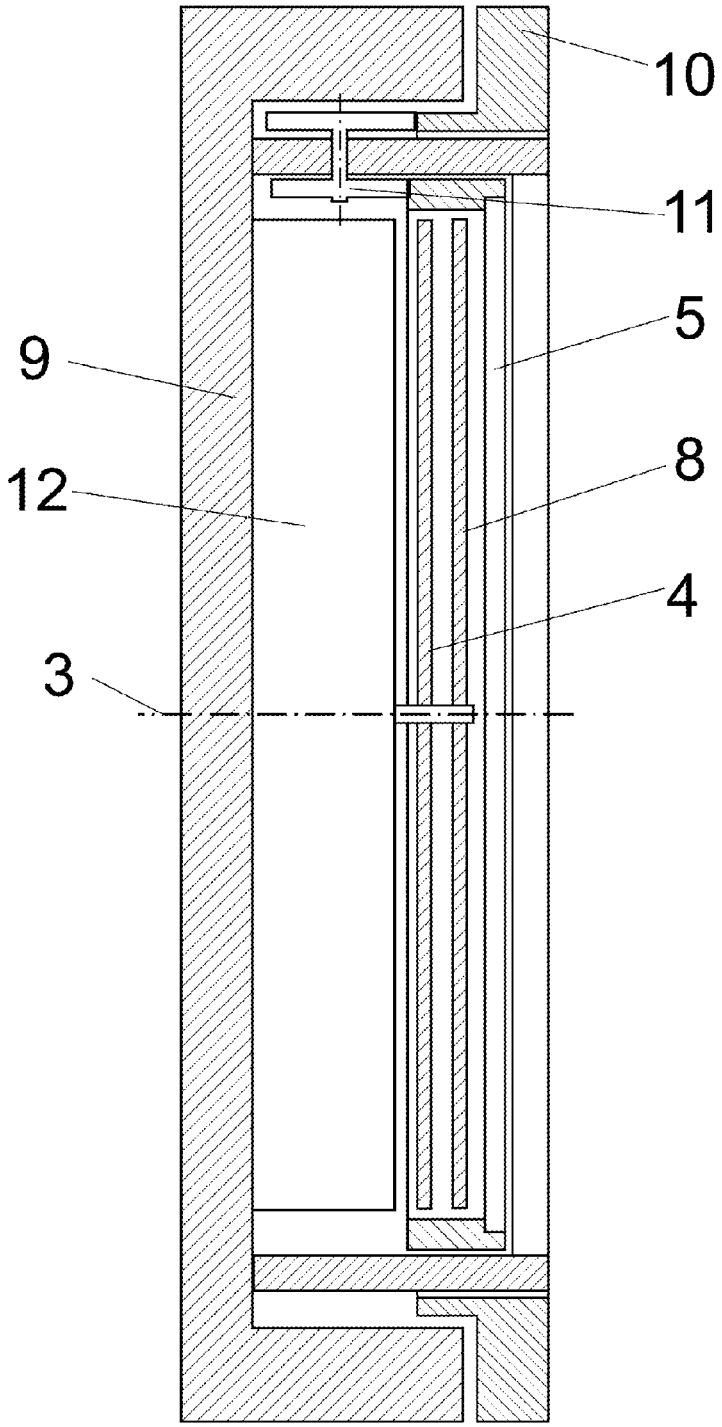
Figure 17:
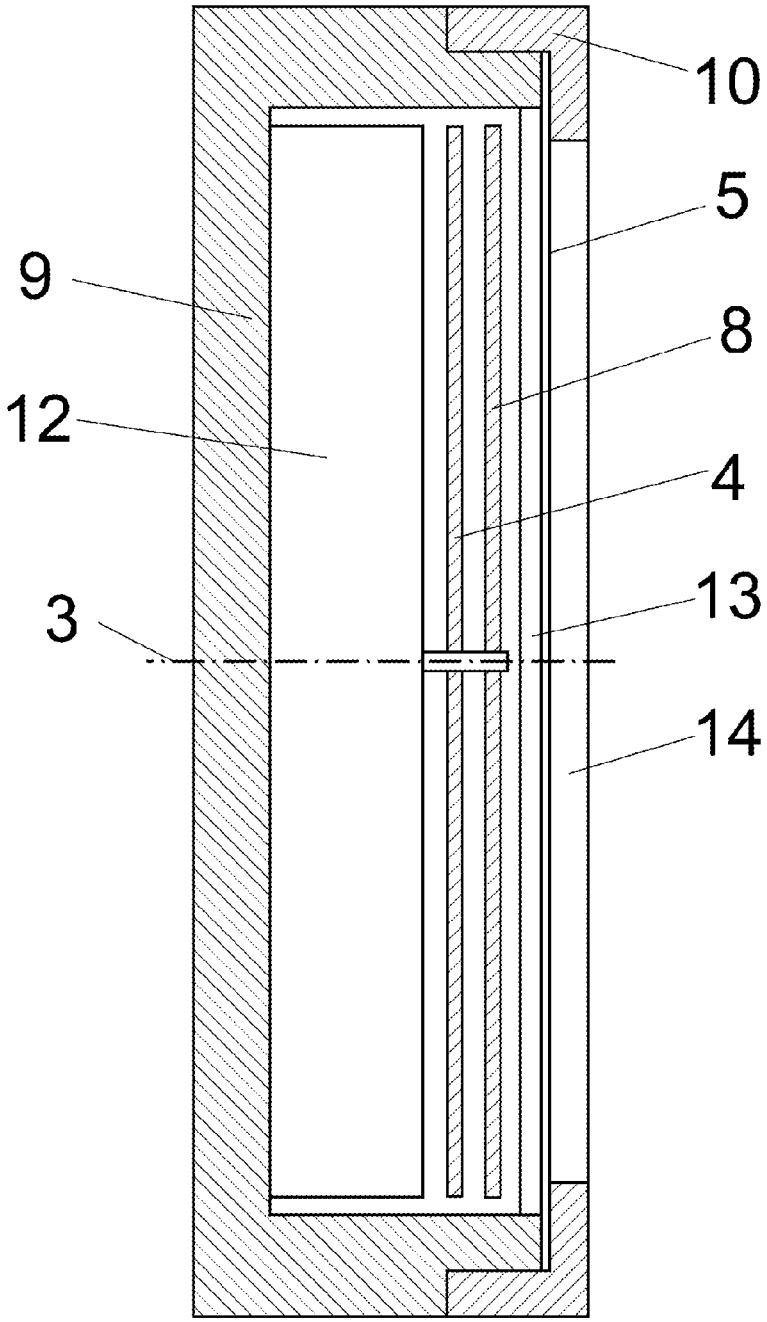

Further embodiments will now be described with reference to figures. In the figures, show:

FIG. 1 an example of a clock with an hour hand shaped in a way that does not allow for a clear recognition of the angular position of the hand, FIG. 2 the example from FIG. 1 with a read element, which allows to determine the angular position of the hour hand, FIG. 3 the example from FIG. 2 after a manual rotation of the read element, such that the read element coincides with the hour hand allowing the current hour to be determined, FIG. 4 an embodiment of the timepiece with an hour hand, a minute hand and a read element, FIG. 5 the embodiment from FIG. 4 after a manual rotation of the read element for determining the current minute, FIG. 6 the embodiment from FIG. 4 after a manual rotation of the read element for determining the current hour, FIG. 7 an example of the timepiece with an hour hand consisting of line-shaped marks with an arrangement that does not allow to read the current hour, FIG. 8 the example of the timepiece from FIG. 7 with a read element, which allows to read the hour hand, FIG. 9 the example of the timepiece from FIG. 8 after the read element was rotated manually in a way allowing to read the current hour, FIG. 10 an embodiment of the timepiece with a partially covered minute hand and a circular hour hand, FIG. 11 the embodiment from FIG. 10 for reading the current minute, FIG. 12 the embodiment from FIG. 10 for reading the current hour, FIG. 13 an embodiment with a conventional hour hand, FIG. 14 the embodiment from FIG. 13 with a read element that covers the hour hand, FIG. 15 the embodiment from FIG. 14 for reading the current hour, FIG. 16 a schematic illustration of a technical realization of the timepiece, and FIG. 17 a schematic illustration of a further technical realization of the timepiece.

DETAILED DESCRIPTION

FIG. 1 shows a timepiece 1 with a 12-hour-scale 2 and a form element 4. In accordance with the 12-hour-scale, the form element 4 rotates at a speed of one rotation every 12 hours about the axis of rotation 3 in clockwise direction. Due to the rotation of the form element 4 in accordance with an hour hand, the form element can also be referred to as hour hand. The hour hand 4 has a shape, which does not allow to determine its exact angular position. The direction in which the hour hand is pointing is not clear. Without a definition in which direction the hour hand is pointing, for example in a user manual, the current hour cannot be read. Even if it would be known in what direction the hour hand is pointing, the shape of the hour hand does not facilitate an exact determination of the angular position and the current time would most likely be read incorrectly or with poor precision.

As shown in FIG. 2, the timepiece 1 features a read element 5 which allows to read the exact angular position of the hour hand 4. With the arrow-shaped form of the read element 5, it is intuitively clear in what direction the read element is pointing, which is why a corresponding definition in a user manual is not required. Furthermore, the read element extends to the edge of the display and therefore reaches the time scale 2. With the read element close to the time scale, an exact determination of the angular position of the read element on the time scale is possible.

FIG. 2 shows the timepiece 1 from FIG. 1 with a read element 5. The read element 5 has a recess 7 corresponding to the shape of the hour hand 4. Furthermore, the read element has a form 55 towards the edge that points in a certain direction 6. In FIG. 2, the read element 5 is in the 12 o'clock position, and thus points to the hour "12". The read element 5 can manually by hand be rotated about at the same rotational axis 3 as the hour hand 4. A manual rotation of the read element 5 is independent of the rotation of the hour hand 4. With a manual rotation of the read element 5, the hour hand 4 continues its rotational motion specified by the movement or clockwork unaffectedly.

The current time can be read when the read element 5 is manually rotated so that it coincides with the hour hand 4. A coincidence of the two elements 4 and 5 in the embodiment in FIG. 2 occurs when the hour hand 4 fills the recess 7 in the read element 5. Since the opening of the read element 5 is not completely filled by the hour hand in FIG. 2, the current hour cannot be read.

In FIG. 3 the timepiece 1 from FIG. 2 is shown after a manual rotation of the read element 5. Here, the hour hand 4 completely fills the recess 7 of the read element 5 and the read element 5 points in the direction 6 of the current hour. Thus, the current hour is 9 o'clock.

Between FIGS. 2 and 3, the read element 5 was manually rotated either 90 degrees counterclockwise or 270 degrees clockwise. In an embodiment, it is for example provided, that the read element 5 is mechanically coupled to a rotatably mounted bezel.

FIG. 4 shows an embodiment of the clock 1 with scale 2, a form element 4, a further form element 8 and a read element 5. All three elements have the same rotational axis 3. When using a 12 hours and 60 minutes scale, the form element performs a full rotation every 12 hours and the further form element performs a full rotation every 60 minutes. The form element can thus be referred to as hour hand and the further form element can be referred to as minute hand. The read element 5 points in the direction 6 of the hour "6" or the minute "30", respectively. Since the read element does not coincide with either the minute hand 8 or the hour hand 4 and the hour and minute hands are shaped in a way that does not allow to correctly determine the direction at which they are pointing, the current time cannot be read in FIG. 4.

FIG. 5 shows the embodiment of FIG. 4 for reading the current minute. One side of the read element 5 coincides with a side of the minute hand 8 and the read element thus points in the direction 6 of the current minute. Thus, the current minute is "0". Analogously, FIG. 6 shows the embodiment of FIG. 4 while reading the hour. Here, the sides of the hour hand 4 and the read element 5 coincide. The read element points in the direction 6 of the current hour, which is "9".

The three FIGS. 4 to 6 thus provide snapshots of a timepiece at the time 9:00 o'clock. For reading the time, the read element 5 was rotated manually by hand within a few seconds, such that the changes in the angular positions of the hour and minute hands due to the continuous progression of time are so small that they are not visible.

In a further embodiment, the display of the current seconds is provided. Since a seconds hand rotates visibly faster than a minute or hour hand, it is possible to design the seconds hand in the same form as the hour or minute hands. When reading the time, the seconds hand in this case is not distinguished from the other hands by a different form, but by the much faster speed of rotation.

FIG. 7 shows an embodiment of a clock 1 with scale 2 and a form element or hour hand 4. To clarify the design of the hour hand 4 the read element is not shown. The hour hand has five linear or line-shaped markings which are printed on a transparent disc. The hour hand rotates around the axis of rotation 3.

In FIG. 8, the embodiment of FIG. 7 is shown with the read element 5. Similar to the hour hand 4, the read element 5 consists of five linear markings on a transparent disc, but has an additional ring-shaped marking 54 at the edge. Based on this ring-shaped marking, the current angular position of the read element 5 can be determined with high accuracy. The read element 5 can be rotated by hand around the rotation axis 3. To read the current hour, the read element 5 must be rotated so that the linear markings of the hour hand 4 and the read element 5 together form a star. Here the endpoints of the markings of the hour hand have to coincide with the endpoints of the linear markings of the read element. If the line-shaped markings form a star, the ring-shaped marking 51 of the read element 5 points at the current hour.

In FIG. 9, the embodiment of the clock 1 from FIGS. 7 and 8 is shown for reading the current hour. Here the read element 5 was manually rotated so that the endpoints of the line-shaped markings of the hour hand and the read element 5 coincide and a star is formed. The ring marking 51 of the read element 5 points at the current hour, which thus is 2 o'clock. Since the star is located eccentrically in relation to the axis of rotation 3, the end points of the linear markings of the hour hand and of the read element 5 meet only in one specific angular position.

FIG. 10 shows a further embodiment of a clock 1. The form element or hour hand 4 consists of a small circular disc and is located at the bottom of the display. A further form element or minute hand 8 consisting of a disc with a large circular hole 81 is located above the hour hand 4. Above the minute hand 8 is located the scale 2, followed by the read element 5. The read element 5 has the same shape as the minute hand 4 with an additional recess 51 on the edge, and a ring 52 in the middle. The ring 52 of the read element has the same diameter as the minute hand. In the present embodiment, the read element 5 is printed on a transparent disc. Hour hand, minute hand and read element 5 have the same axis of rotation 3.

In the example in FIG. 10, due to the shape of the hour hand 4, the current hour cannot be read or only with poor precision. Furthermore, the read element 5 partially covers the minute hand 8, whereby the current minute can also only be read with poor precision. The scale 2 is also partially covered by the read element and visible only in the immediate vicinity of the recess 51. The scale can thus be used for an accurate determination of the angular position of the read element.

FIG. 11 shows the embodiment of FIG. 10 for reading the current minute. Here, the read element 5 has been rotated by hand so that the hole 53 of the read element coincides with the hole 81 of the minute hand 8. The minute hand is thus completely hidden under the read element. In this position, the recess 51 of the read element points at the current minute which is "0".

In FIG. 12, the clock 1 from the embodiment of FIGS. 10 and 11 is shown for reading the hour. Starting from FIG. 11, the read element 5 was rotated by 60 degrees clockwise, so that the ring 52 coincides with the hour hand 4. In this arrangement of coincidence, the recess 51 of the read element points at the current hour, which thus is "2". In combination with the minute read in FIG. 11, the time is 2:00 o'clock.

In a further embodiment of the example of FIGS. 10 to 12, the display of the time in another time zone is provided. For this purpose a further hour hand is used, which is arranged directly above the circular hour hand 4. The further hour hand has the same shape, size and eccentricity as the hour hand. The further hour hand is partially transparent so that the underlying hour hand 4 is visible. Owing to the similar shape of the two hour hands, their angular positions can be read with the ring 52 of the read element 5.

FIG. 13 shows an embodiment of the timepiece 1 with an hour hand 4, which is shaped like a conventional clock hand and thus corresponds to a radial line starting from the center of the display. The rotational axis 3 of the hour hand 4 matches the center of the display. As shown in FIG. 14, a circular read element 5 with center equal to the center of the display is located above the hour hand 4. The read element 5 can be manually rotated about the axis of rotation 3 of the hour hand 4 at the center of the display. The read element consists of a non-transparent material and has four radially-extending linear recesses 56. Through the recesses 56, the underlying elements of the display are visible. As shown in FIG. 14, the hour hand is fully covered by the read element in the angular positions in which the read element does not coincide with the hour hand and the current time cannot be read.

FIG. 15 shows the reading position of the timepiece 1 from FIG. 14. Here, one of the recesses 56 of the read element 5 coincides with the hour hand 4, such that the hour hand 4 is visible through the recess 56 of the read element 5. When the read element and the hour hand coincide, the hour hand points to the current hour. The use of multiple recesses 56 in the reading hand 5 has the advantage that, for reading the current hour, the reading hand does not have to be rotated as far until the hour hand coincides with one of the recesses of the read element.

A technical realization of the timepiece is shown in FIG. 16. Here, a watch case 9 is used with a rotating bezel 10. The bezel is coupled with the read element 5 through a gear 11 so that a rotation of the bezel results in a rotation of the read element. The movement 12 drives an hour hand 4 and a minute hand 8 and is not mechanically coupled with the bezel or the read element. All three hands have the same axis of rotation 3, and are represented in the form of transparent discs on which any shapes, markings or geometries of hands can be applied.

Another technical realization of the timepiece is shown in FIG. 17. The watch case 9 has a crystal 13 and includes a movement 12 with hour 4 and minute hands 8. A bezel 10 is rotatably mounted above the crystal 13 with a further crystal 14. On the inside of the further crystal 14, the read element 5 is applied. The scale of the display can be applied to the crystal 13. The use of two crystals 13, 14 above the hands 4, 8 has the advantage that the movement can be sealed with high water resistance, whereas a sealing with very low friction for rotation can be used for the bezel.

For the movement shown in FIGS. 16 and 17 both a quartz movement with battery and a mechanical movement with manual winding or automatic winding can be used.

A technical effect and benefit of the proposed timepiece as opposed to the timepiece from the document DE 10 2010 020 466 A1 is that the rotational speeds of the hands and the manual or automatic winding mechanism and the time-setting mechanism of conventional movements can be used without modifications for the realization of the proposed timepiece.

In another embodiment, the read element 5 is coupled to the drive shaft of the seconds hand of the movement, so that the read element 5 also serves as a seconds hand. When manually rotating the read element to read the hour and minute, hence, the displayed second is adjusted. By means of a friction connection between the read element and the axis of the seconds hand of the movement it is ensured that a manual rotation of the read element does not damage the gears of the movement. With a manual rotation of the read element, therefore, the transfer of the seconds hand drive of the movement to the read element is blocked. After manual rotation of the read element, the second is therefore not displayed correctly. The coupling of the read element to the manual rotation can be based on a ratchet mechanism. Here the read element can manually only be rotated in counterclockwise direction while the seconds hand drive of the movement drives the read element in clockwise direction. Alternatively, the bezel may be connected with the read element by pressing down the bezel, wherein a toothing of the bezel is coupled to a toothing of the read element.

In a quartz movement which has a separate stepper motor for each hand, the rotation of the read element can be controlled by means of a manual operation of pushers or crowns on the watch case, and then executed by one of the stepper motors of the timepiece. Since the stepper motors of the movement can be controlled independently, the indirectly produced manual rotation of the read element does not affect the rotational motion of the hour and minute hands. The clock display can also be equipped with a touch-sensitive window as known from touchscreens. Here the touches of the window can be converted into a rotation of the read element by one of the stepper motors of the movement.

The use of a separately controllable stepper motor to perform the manually controlled rotation of the read element allows the use of the read element as seconds hand, without the loss of the current second after a manually controlled rotation of the read element. This is due to the fact that the electronics of the movement can calculate the position of the read element relative to the current second. After a manually controlled rotation of the read element, the movement can thus rotate the read element to the current second and continue the motion to display the current second.

The timepiece can be implemented both mechanically as described in FIGS. 16 and 17, or as an animation displayed on a monitor or projected onto a screen using a projector. When displaying or projecting the timepiece on a screen, any input device can be used for manual rotation of the read element, e.g. the keys on a keyboard or a mouse, the scroll wheel of a mouse, a stylus or finger on a touchscreen or a trackpad or trackball.

The features disclosed in the above description, the claims and the figures can be of importance both individually and in any given combination for the implementation in its various implementations.

The invention claimed is:

1. A timepiece to display a value of a time unit, comprising:

a read element, wherein a rotation of the read element is controlled manually; and a form element that rotates according to the time unit, wherein the rotation of the form element is independent of a manually induced rotation of the read element;

wherein the value of the time unit is only read when the read element and the form element coincide, in that an angular position of the coincidence indicates the value of the time unit.

2. The timepiece according to claim 1, wherein for reading the value of the time unit, the read element is rotated manually such that the read element and the form element coincide.

3. The timepiece according to claim 1, wherein a rotation of the read element stops when the read element coincides with the form element for reading the value of the time unit.

4. The timepiece according to claim 1, wherein the read element and the form element rotate about a same axis.

5. The timepiece according to claim 1, wherein the coincidence of read element and form element is only effected in a rotational position in which the form element and/or the read element indicate the value of the time unit.

6. The timepiece according to claim 1, with a timescale in accordance with the time unit, wherein the form element and/or the read element only indicate the value of the time unit on the timescale when the read element coincides with the form element.

7. The timepiece according to claim 1, wherein the coincidence of the read element with the form element for reading the time is effected by:

a partial or complete overlapping of the form element and the read element;

a partial or complete framing of one element of the read element and the form element by the other element of the form element and the read element;

a coincidence of at least one side or at least one endpoint of one element of the read element and the form element with at least one side or at least one endpoint of the other element of the read element and the form element or a combination thereof.

8. The timepiece according to claim 1, wherein the way the coincidence of the form element and the read element is effected is equal for all values of the time unit to be displayed by the timepiece.

9. The timepiece according to claim 1, wherein the indication of a value of a further time unit is provided and a further form element rotates in accordance with the further time unit and the value of the further time unit is displayed similar to the interaction of the read element and the form element, only when the further form element coincides with the read element or a further read element, such that the read element or the further read element and/or the further form element indicate the value of the further time unit.

10. The timepiece according to claim 1, wherein at least one element of the display has a disk-shaped figure.

11. The timepiece according to claim 10, wherein the disk-shaped figure rotates eccentrically.

12. The timepiece according to claim 1, wherein at least one element of the display has at least one line-shaped or surface marking or recess of any shape on a disk-shaped figure.

13. The timepiece according to claim 1, wherein at least a part of the shape, marking or recess of a read element corresponds to at least a part of the shape, marking or recess of a form element.

14. The timepiece according to claim 1, wherein the form element is covered at least partially by another element of the display.

15. The timepiece according to claim 1, wherein the read element has a shape, recess or marking towards the edge, which increases the reading accuracy.

16. The timepiece according to claim 1, wherein the read element rotates according to a seconds hand and a manually controlled rotation of the read element temporarily interrupts the rotation according to a seconds hand for the duration of the manually controlled rotation of the read element.

17. The timepiece according to claim 1, wherein the elements of the display consist of one or different solid materials.

18. The timepiece according to claim 1, wherein the form element is rotated by a movement or clockwork with a quartz crystal or a balance wheel as time base.

19. The timepiece according to claim 1, wherein the elements of the display are displayed on a monitor or projected onto a screen.

20. The timepiece according to claim 1, wherein the time unit of the value to be displayed by the coincidence of a read element and a form element is the hour, minute or seconds.

* * * * *